US010473411B2

(12) United States Patent
Garosshen

(10) Patent No.: US 10,473,411 B2
(45) Date of Patent: Nov. 12, 2019

(54) ALUMINUM ALLOY FINNED HEAT EXCHANGER

(71) Applicant: CARRIER CORPORATION, Farmington, CT (US)

(72) Inventor: Thomas J. Garosshen, Glastonbury, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 80 days.

(21) Appl. No.: 15/536,633

(22) PCT Filed: Dec. 17, 2015

(86) PCT No.: PCT/US2015/066333
§ 371 (c)(1),
(2) Date: Jun. 16, 2017

(87) PCT Pub. No.: WO2016/100640
PCT Pub. Date: Jun. 23, 2016

(65) Prior Publication Data

US 2018/0003450 A1 Jan. 4, 2018

Related U.S. Application Data

(60) Provisional application No. 62/093,246, filed on Dec. 17, 2014.

(51) Int. Cl.
*F28F 21/08* (2006.01)
*F28F 1/12* (2006.01)
(Continued)

(52) U.S. Cl.
CPC ..... *F28F 21/084* (2013.01); *F28F 1/126* (2013.01); *F28F 1/24* (2013.01); *F28F 19/06* (2013.01); *F28F 2215/00* (2013.01)

(58) Field of Classification Search
CPC .. F28F 21/084; F28F 1/126; F28F 1/24; F28F 19/06; F28F 2215/00
(Continued)

(56) References Cited

U.S. PATENT DOCUMENTS 4,196,262 A * 4/1980 Pryor ..... B23K 35/286 420/537
4,317,484 A * 3/1982 Tanabe ..... F28F 19/004 165/134.1
(Continued)

FOREIGN PATENT DOCUMENTS

CN 1177070 C 11/2004
CN 101063206 A 10/2007
(Continued)

OTHER PUBLICATIONS

International Search Report regarding related PCT App. No. PCT/US2015/066333; dated Mar. 22, 2016; 6 pgs.
(Continued)

*Primary Examiner* — Justin M Jonaitis
(74) *Attorney, Agent, or Firm* — Cantor Colburn LLP

(57) ABSTRACT

A heat exchanger includes a conduit of a first aluminum alloy and a plurality of fins in thermally conductive contact with the exterior of the conduit. The fins include a second aluminum alloy comprising from 0.005 wt. % to 0.1 wt. % of at least one alloying element selected from tin, barium, indium, mercury, and gallium.

19 Claims, 3 Drawing Sheets

(51) Int. Cl.
*F28F 1/24* (2006.01)
*F28F 19/06* (2006.01)

(58) Field of Classification Search
USPC ..... 165/133, 172, 177, 181, 148, 151
See application file for complete search history.

(56) References Cited

U.S. PATENT DOCUMENTS

| | | | | |
|---|---|---|---|---|
| 4,357,397 | A * | 11/1982 | Baba | B23K 1/19 148/535 |
| 4,571,368 | A * | 2/1986 | Fenoglio | C22C 21/02 204/196.22 |
| 4,991,647 | A * | 2/1991 | Kawabe | B32B 15/016 165/134.1 |
| 5,217,547 | A | 6/1993 | Ishikawa et al. | |
| 7,798,205 | B2 | 9/2010 | Minami et al. | |
| 8,281,489 | B2 | 10/2012 | Zobel et al. | |
| 8,640,766 | B2 | 2/2014 | Katsumata et al. | |
| 2003/0082068 | A1 | 5/2003 | Wittebrood et al. | |
| 2005/0106410 | A1 | 5/2005 | Jiang et al. | |
| 2005/0150642 | A1 | 7/2005 | Baumann | |
| 2010/0051247 | A1 | 3/2010 | Sogabe et al. | |
| 2012/0145365 | A1 | 6/2012 | Yamashita et al. | |
| 2013/0118013 | A1 | 5/2013 | Yamashita et al. | |
| 2014/0034713 | A1 | 2/2014 | Wittebrood et al. | |

FOREIGN PATENT DOCUMENTS

| | | | | |
|---|---|---|---|---|
| CN | 101871062 | A | 10/2010 | |
| CN | 101928861 | A | 12/2010 | |
| CN | 103502493 | A | 1/2014 | |
| CN | 104919070 | A | 9/2015 | |
| JP | 2002086295 | A | 3/2002 | |
| JP | 2006194556 | A | 7/2006 | |
| JP | 2011007385 | A | 1/2011 | |
| WO | 9817841 | | 4/1998 | |
| WO | 2012143183 | A1 | 10/2012 | |
| WO | 2013155355 | A1 | 10/2013 | |
| WO | WO-2013155384 | A2 * | 10/2013 | F28F 21/084 |

OTHER PUBLICATIONS

Written Opinion regarding related PCT App. No. PCT/US2015/066333; dated Mar. 22, 2016; 4 pgs.

Chinese Office Action from the Chinese Patent Office for CN Application No. 201580068745.4 dated Dec. 5, 2018, 14 pages.

* cited by examiner

ALUMINUM ALLOY FINNED HEAT EXCHANGER

CROSS-REFERENCE TO RELATED APPLICATIONS

This is a National Stage of International Patent Application Serial No. PCT/US2015/066333, filed Dec. 17, 2015, which claims the benefit of priority to U.S. Provisional Patent Application Ser. No. 62/093,246, filed Dec. 17, 2014, which is incorporated herein by reference in its entirety.

BACKGROUND OF THE INVENTION

The subject matter disclosed herein generally relates to heat exchangers and, more specifically, to alloys for finned heat exchangers.

Heat exchangers are widely used in various applications, including but not limited to heating and cooling systems including fan coil units, heating and cooling in various industrial and chemical processes, heat recovery systems, and the like, to name a few. Many heat exchangers for transferring heat from one fluid to another fluid utilize one or more tubes through which one fluid flows while a second fluid flows around the tubes. Heat from one of the fluids is transferred to the other fluid by conduction through the tube walls. Many configurations also utilize fins in thermally conductive contact with the outside of the tube(s) to provide increased surface area across which heat can be transferred between the fluids, improve heat transfer characteristics of the second fluid flowing through the heat exchanger and enhance structural rigidity of the heat exchanger. Such heat exchangers include microchannel heat exchangers and round tube plate fin (RTPF) heat exchangers.

Heat exchanger tubes may be made from a variety of materials, including metals such as aluminum or copper and alloys thereof. Aluminum alloys are lightweight, have a high specific strength and high-heat conductivity. Due to these excellent mechanical properties, aluminum alloys are used as heat exchangers for heating or cooling systems in commercial, industrial, residential, transport, refrigeration, and marine applications. However, aluminum alloy heat exchangers have a relatively high susceptibility to corrosion. Corrosion eventually leads to a loss of refrigerant from the tubes and failure of the heating or cooling system. Sudden tube failure results in a rapid loss of cooling and loss of functionality of the heating or cooling system. Many aluminum alloys are of course known, each having a relative susceptibility or resistance to corrosion. However, many alloys reported to have relatively high resistance to corrosion may not have desired physical properties for use as heat exchanger fins or may not have desired formability characteristics for fin fabrication and assembly with heat exchanger tubes or channels. For example, conventional anodic aluminum alloys such as alloy 7072 suffer from limitations on formability, which is particularly problematic for heat exchangers having low fpi (fins per inch) counts, with correspondingly high collar dimensions. For some heat exchanger designs with lower fpi counts, 7072 fins are subject to cracking and other defects at lower fpi counts due to 7072's limited formability. For such designs, 7072 is limited in the minimum fpi count that can be achieved.

In view of the above and other considerations, further contributions to the field of aluminum alloys for heat exchangers are well-received in the art.

BRIEF DESCRIPTION OF THE INVENTION

According to an aspect of the invention, a heat exchanger comprises a conduit comprising a first aluminum alloy and a plurality of fins in thermally conductive contact with the exterior of the conduit. The fins comprise a second aluminum alloy comprising from 0.005 wt. % to 0.10 wt. % of at least one alloying element selected from tin, barium, indium, mercury, gallium, and thallium.

In some embodiments, the alloying element is selected from indium or gallium.

In some embodiments, the second aluminum alloy comprises from 0.005 wt. % to 0.05 wt. % of the at least one alloying element.

In some embodiments, the second aluminum alloy comprises from 0.01 wt. % to 0.03 wt. % of the at least one alloying element.

In some embodiments, the solution electronegative potential of the second aluminum alloy is at least 100 mV more negative than that of the first aluminum alloy.

In some embodiments, the second aluminum alloy further comprises from 0.5 to 6.0 wt. % zinc or magnesium.

In some embodiments, the second aluminum alloy further comprises from 1 to 5 wt. % zinc or magnesium.

In some embodiments, the second aluminum alloy further comprises from 2 to 5 wt. % zinc or magnesium.

In some embodiments, the second aluminum alloy further comprises from 0.05 to 1.0 wt. % iron or silicon.

In some embodiments, the second aluminum alloy further comprises from 0.1 to 0.5 wt. % iron or silicon.

In some embodiments, the second aluminum alloy comprises an alloy selected from a 3000 or 8000 series aluminum alloy, with the alloying element and any zinc, magnesium, iron, or silicon added thereto in the amounts specified above.

In some embodiments, the second aluminum alloy comprises an alloy selected from AA1100, AA1145 AA7072, AA8005, AA8006, and AA8011, with the alloying element and any zinc, magnesium, iron, or silicon added thereto in the amounts specified above.

In some embodiments, the fins are formed from the second aluminum alloy.

In some embodiments, the fins comprise a fin body portion and a fin surface layer portion, wherein the fin surface layer portion comprises the second aluminum alloy and the fin body portion comprises a third aluminum alloy.

In some embodiments, the third aluminum alloy comprises an alloy selected from AA1100, AA1145 AA7072, AA8006, and AA8011.

In some embodiments, the fin surface layer covers a region of the fin body portion in contact with the exterior of the conduit.

In some embodiments, the fin surface layer encases the fin body portion.

In some embodiments, the fin surface layer has a thickness of 5-50 microns.

In some embodiments, the fin surface layer has a thickness of 15-250 microns.

In some embodiments, the fin surface layer is applied by a cold spray or thermal spray process or vapor deposition.

In some embodiments, the fin surface layer is applied by cold gas spray deposition.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
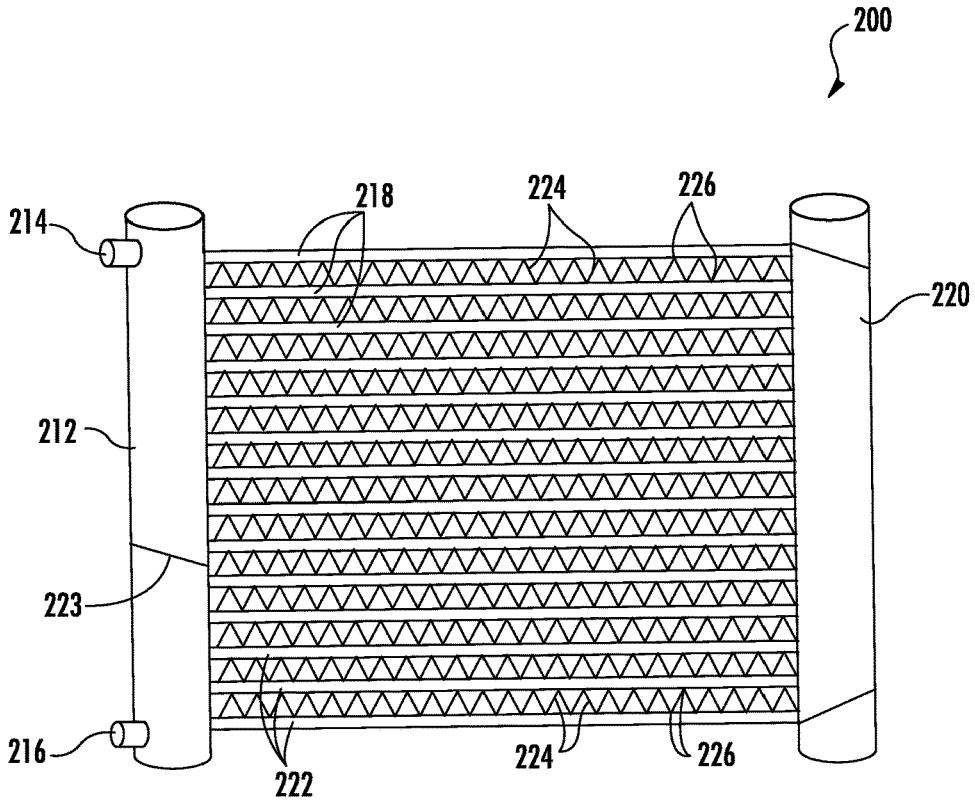
FIG. 1 depicts a schematic diagram of an exemplary heat exchanger.

Referring now to the drawings, FIG. 1 depicts a micro-channel or mini-channel type of heat exchanger. The configuration of these types of heat exchangers is generally the same, with the primary difference being rather loosely applied based on the size of heat transfer tube ports. For the sake of convenience, this type of heat exchanger will be referred to herein as a micro-channel heat exchanger. As shown in FIG. 1, a micro-channel heat exchanger 200 includes first manifold 212 having inlet 214 for receiving a working fluid, such as coolant, and outlet 216 for discharging the working fluid. First manifold 212 is fluidly connected to each of a plurality of tubes 218 that are each fluidly connected on an opposite end with second manifold 220. It should be noted here that the term "tube", as used herein, means conduit and includes any type of channel or conduit of any shape or configuration, including but not limited to those with round, rectangular and square shaped cross-sections. Second manifold 220 is fluidly connected with each of a plurality of tubes 222 that return the working fluid to first manifold 212 for discharge through outlet 216. Partition 223 is located within first manifold 212 to separate inlet and outlet sections of first manifold 212. Tubes 218 and 222 can include channels, such as microchannels, for conveying the working fluid. The two-pass working fluid flow configuration described above is only one of many possible design arrangements. Single and other multi-pass fluid flow configurations can be obtained by placing partitions 223, inlet 214 and outlet 216 at specific locations within first manifold 212 and second manifold 220.

Fins 224 extend between tubes 218 and the tubes 222 as shown in the Figure. Fins 224 support tubes 218 and tubes 222 and establish open flow channels between the tubes 218 and tubes 222 (e.g., for airflow) to provide additional heat transfer surfaces and enhance heat transfer characteristics. Fins 224 also provide support to the heat exchanger structure. Fins 224 are bonded to tubes 218 and 222 at brazed joints 226. Fins 224 are not limited to the triangular cross-sections shown in FIG. 2, as other fin configurations (e.g., rectangular, trapezoidal, oval, sinusoidal) can be used as well. Fins 224 may have louvers to improve heat transfer.

Figure 2:
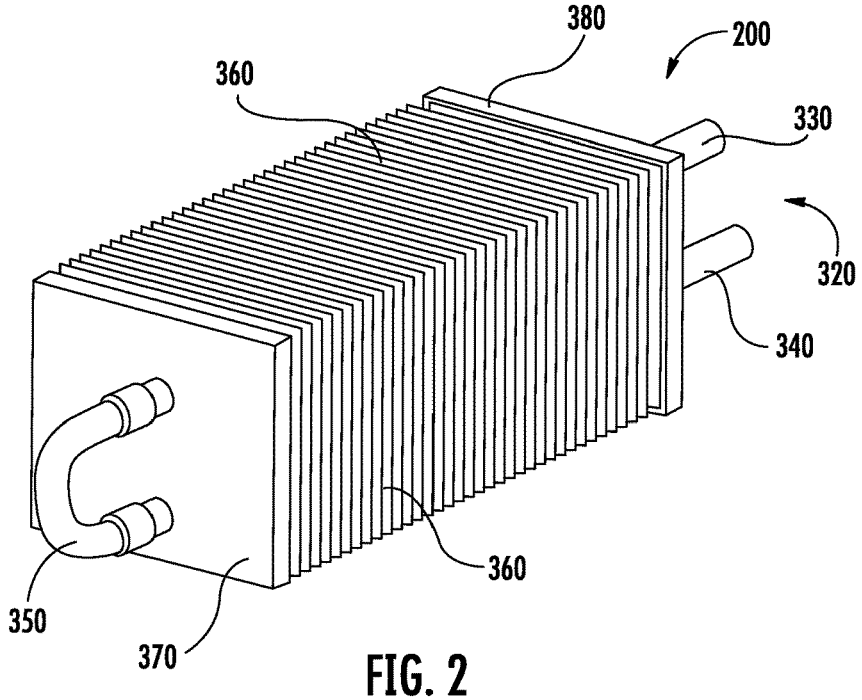
FIG. 2 depicts a schematic diagram of another exemplary heat exchanger.

Referring now to FIG. 2, an exemplary RTPF (round tube plate fin) heat exchanger is shown. As shown in FIG. 2, a heat exchanger 200 includes one or more flow circuits for carrying refrigerant. For the purposes of explanation, the heat exchanger 200 is shown with a single flow circuit refrigerant tube 320 consisting of an inlet line 330 and an outlet line 340. The inlet line 330 is connected to the outlet line 340 at one end of the heat exchanger 200 through a 90 degree tube bend 350. It should be evident, however, that more circuits may be added to the unit depending upon the demands of the system. For example, although tube bend 350 is shown as a separate component connecting two straight tube section, the tube 320 can also be formed as a single tube piece with a hairpin section therein for the tube bend 350, and multiple units of such hairpin tubes can be connected with u-shaped connectors at the open ends to form a continuous longer flow path in a 'back-and-forth' configuration. The heat exchanger 200 further includes a series of fins 360 comprising radially disposed plate-like elements spaced along the length of the flow circuit, typically connected to the tube(s) 320 with an interference fit. The fins 360 are provided between a pair of end plates or tube sheets 370 and 380 and are supported by the lines 330, 340 in order to define a gas flow passage through which conditioned air passes over the refrigerant tube 320 and between the spaced fins 360. Fins 360 may include heat transfer enhancement elements such louvers.

The refrigerant tubes can be made of an aluminum alloy based core material and, in some embodiments, may be made from aluminum alloys selected from 1000 series, 3000 series, 5000 series, or 6000 series aluminum alloys. The fins can include aluminum alloy substrate materials such as, for example, materials selected from the 1000 series, 3000 series, 6000 series, 7000 series, or 8000 series aluminum alloys (as used herein, all alloy numbers and alloy series numbers and individual alloy numbers are as specified by The Aluminum Association). The embodiments described herein utilize an aluminum alloy for the fins of a tube-fin heat exchanger having an aluminum alloy tube, i.e., a so-called "all aluminum" heat exchanger. In some embodiments, components through which refrigerant flows, such as tubes and/or manifolds, can be made of an alloy that is electrochemically more cathodic than connected components through which refrigerant does not flow (e.g., fins). This ensures that any galvanic corrosion will occur in non-flow-through components rather than in flow-through components, in order to avoid refrigerant leaks.

As mentioned above, heat exchanger component connections, such as between tubes and fins, or between tubes and manifolds, can be connected by brazing. Brazing compositions for aluminum components are well-known in the art as described, for example, in U.S. Pat. Nos. 4,929,511, 5,820,698, 6,113,667, and 6,610,247, and US published patent application 2012/0170669, the disclosures of each of which are incorporated herein by reference in their entirety. Brazing compositions for aluminum can include various metals and metalloids, including but not limited to silicon, aluminum, zinc, magnesium, calcium, lanthanide metals, and the like. In some embodiments, the brazing composition includes metals more electrochemically anodic than aluminum (e.g., zinc), in order to provide sacrificial galvanic corrosion in the braze joint(s) instead of the refrigerant tube(s). A flux material can be used to facilitate the brazing process. Flux materials for brazing of aluminum components can include high melting point (e.g., from about 564° C. to about 577° C.), such as LiF and/or $KAlF_4$. Other compositions can be utilized, including cesium, zinc, and silicon. The flux material can be applied to the aluminum alloy surface before brazing, or it can be included in the brazing composition.

As mentioned above, the heat exchanger fins comprise a second aluminum alloy comprising from 0.01 wt. % to 1.0 wt. % of at least one alloying element selected from tin, barium, indium, mercury, gallium, and thallium. In some more specific embodiments, the second aluminum alloy comprises from 0.01 wt. % to 0.05 wt. % of the at least one alloying element, and even more specifically from 0.01 wt. % to 0.03 wt. % of the at least one alloying element. In some more specific embodiments, the at least one alloying element is selected from indium or gallium.

Figure 3:
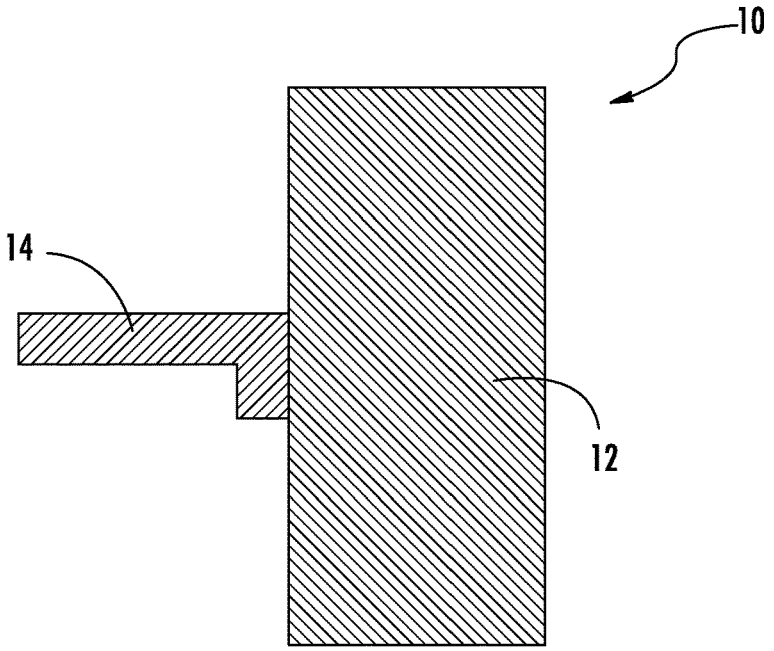
FIG. 3 depicts a schematic diagram of a cross-sectional view of a portion of a finned heat exchanger.
Figure 4:
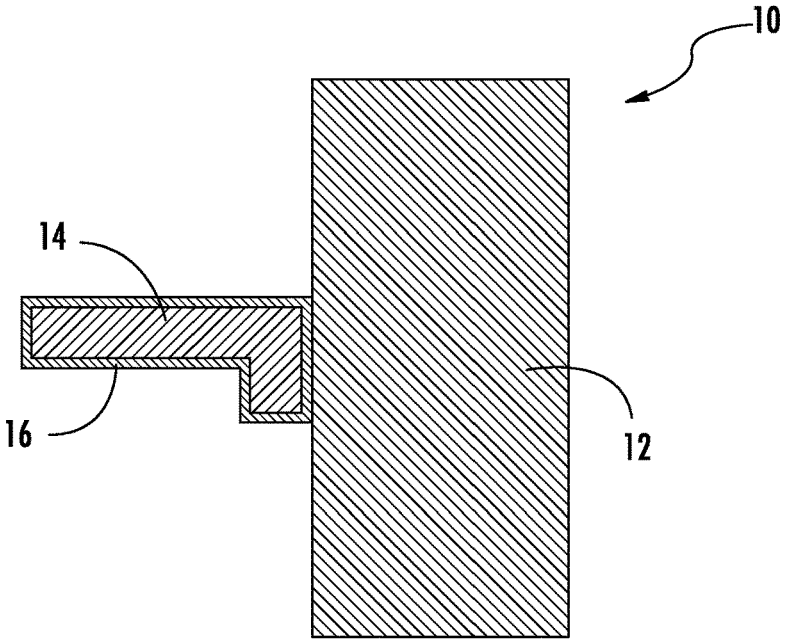
FIG. 4 depicts a schematic diagram of a cross-sectional view of a portion of a finned heat exchanger.
Figure 5:
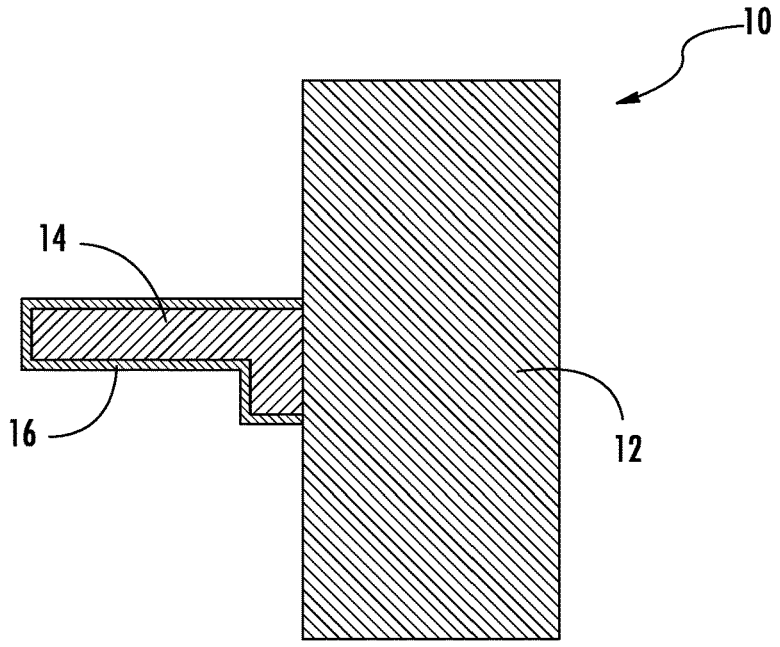
FIG. 5 depicts a schematic diagram of a cross-sectional view of a portion of a finned heat exchanger.
Figure 6:
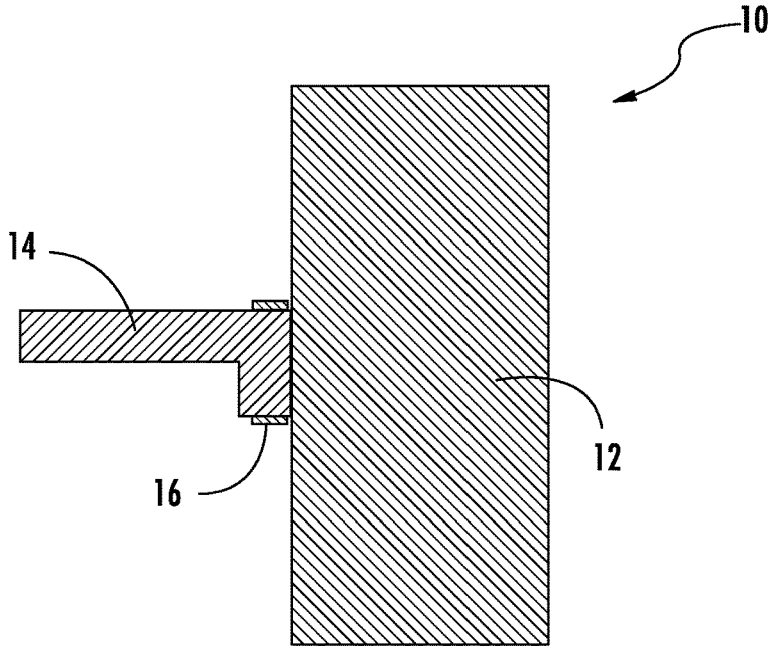
FIG. 6 depicts a schematic diagram of a cross-sectional view of a portion of a finned heat exchanger.

Turning now to FIGS. 3-6, an exemplary portion of a tube and fin assembly 10 is shown in FIGS. 3-6, where fin 14 is attached to tube 12. In some embodiments, the second aluminum alloy can be used as the principal alloy out of which the heat exchanger fins are formed, as shown in FIG. 3 where fin 14 is formed from the second aluminum alloy. In some embodiments, the second aluminum alloy is present as a surface layer on fins formed from a third aluminum alloy, as shown in FIG. 4 where fin 14 has a surface layer 16 comprising the second aluminum alloy. The third aluminum alloy can be any aluminum alloy useful for fabricating finstock, including but not limited to AA1000, AA7000, AA AA8000 series alloys such as AA1100, AA1145, AA7072, AA8005, or AA8011, the alloy designations used herein being according to the International Alloy Designations and Chemical Composition Limits for Wrought Aluminum and Wrought Aluminum Alloys, published by The Aluminum Association. The surface layer can have a thickness ranging from 15 to 250 microns, more specifically from 15 to 200 microns. In some embodiments, the surface layer comprising the second aluminum alloy encases the fin, including as shown in FIG. 4. In some embodiments, the surface layer comprising the second aluminum alloy covers a region of the fin body portion adjacent to the point of contact with the exterior of the tube 12, but leaves uncovered other portions of the fin body remote from the exterior of the tube 12. For example, in some exemplary embodiments such as shown in FIG. 5, the surface layer 16 leaves the fin area in contact with the tube 12 uncoated. Such a configuration can promote good heat transfer while also providing corrosion resistance. In other exemplary embodiments such as shown in FIG. 6, the surface layer 16 covers part of the fin surface near the tube 12 and does not cover the tube/fin interface.

In some embodiments, the above-described surface layer can be applied to before brazing. Various techniques can be used to apply the anodic metal, such as electrodeposition, physical vapor deposition, or various methods of thermal spray such as plasma spray, flame spray, cold gas spray deposition (CGSD), HVOF, and other known thermal spray techniques. In a more specific exemplary embodiment, the surface layer is applied by CGSD. Alternatively, a layer of the second alloy can be physically applied to the surface and then heated, as is known in the art. The surface layer can be thermally diffused into the aluminum substrate, e.g., to a depth of 80-100 μm.

Although the present invention is not defined by or limited to any particular theory or mode of operation, it is believed that the alloying elements in the second aluminum alloy may interfere with the formation of the thin protective oxide layer that typically forms on the surface of aluminum alloys, thereby allowing corrosion to more readily occur on the fin surface. In some embodiments, the alloying element in the second aluminum alloy can be used in conjunction with other techniques, materials, and product configurations that also promote corrosion to preferentially occur in heat exchanger fins instead of the refrigerant-carrying tubes, although the alloying element can also be used by itself. In some embodiments, the second aluminum alloy further comprises the presence of elements to make the solution electronegative potential of the second aluminum alloy at least 100 mV more negative than that of the first aluminum alloy. In some embodiments, the 0.5 wt. % to 6.0 wt. % magnesium or zinc, more specifically from 1 wt. % to 5 wt. % magnesium or zinc, and even more specifically from 2 wt. % to 5 wt. % magnesium or zinc. The presence of elements such as magnesium or zinc tends to make aluminum alloys have a more negative solution electronegative solution potential, which causes any galvanic corrosion to occur in the fins rather than the tubes. In some embodiments, the second aluminum alloy further comprises the presence of elements such as iron or silicon that form intermetallic particles intermetallic particles, which can also interfere with the formation of the protective oxide film on the heat exchanger fins. In some embodiments, the second aluminum alloy comprises from 0.05 wt. % to 1.0 wt. % iron or silicon, more specifically from 0.1 wt. % to 0.5 wt. % iron or silicon, and even more specifically from 0.1 wt. % to 0.5 wt. % iron or silicon.

The second aluminum alloy described herein can be based on a base aluminum alloy with the at least one alloying element and optional zinc, and magnesium added to the base alloy to form the second aluminum alloy. Exemplary base aluminum alloys include AA1100, AA1145 AA7072, AA8005, AA8006, and AA8011, and mixtures thereof.

The compositions of these alloys and techniques for preparing aluminum alloys are well-known in the art. Exemplary embodiments of such compositions are described, for example, in Aluminum and Aluminum Alloys, ASM Specialty Handbook, J. R. Davis, ASM International, the disclosure of which is incorporated herein by reference in its entirety.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger, comprising:

a conduit comprising a first aluminum alloy; and a plurality of fins in thermally conductive contact with the exterior of said conduit, said fins comprising a second aluminum alloy comprising from 0.5 to 6.0 wt. % zinc, and from 0.005 wt. % to 0.1 wt. % of at least one alloying element selected from barium, mercury, and gallium.

2. The heat exchanger of claim 1, wherein said alloying element comprises gallium.

3. The heat exchanger of claim 1, wherein the second aluminum alloy comprises from 0.005 wt. % to 0.05 wt. % of said at least one alloying element.

4. The heat exchanger of claim 1, wherein the second aluminum alloy comprises from 0.01 wt. % to 0.03 wt. % of said at least one alloying element.

5. The heat exchanger of claim 1, wherein the solution electronegative potential of the second aluminum alloy is at least 100 mV more negative than that of the first aluminum alloy.

6. The heat exchanger of claim 1, wherein the second aluminum alloy comprises from 1 to 5 wt. % zinc.

7. The heat exchanger of claim 1, wherein the second aluminum alloy comprises from 2 to 5 wt. % zinc.

8. The heat exchanger of claim 1, wherein the second aluminum alloy further comprises from 0.05 to 1 wt. % iron or silicon.

9. The heat exchanger of claim 1, wherein the second aluminum alloy further comprises from 0.1 to 0.5 wt. % iron or silicon.

10. The heat exchanger of claim 9, wherein the second aluminum alloy comprises an alloy selected from AA1100, AA1145 AA7072, AA8005, AA8006, and AA8011, with the alloying element and any zinc, magnesium, iron, or silicon added thereto in the amounts specified in any of claims 1-9.

11. The heat exchanger of claim 1, wherein the fins are formed from the second aluminum alloy.

12. The heat exchanger of claim 1, wherein the fins comprise a fin body portion and a fin surface layer portion, wherein the fin surface layer portion comprises the second aluminum alloy and the fin body portion comprises a third aluminum alloy.

13. The heat exchanger of claim 12, wherein the third aluminum alloy comprises an alloy selected from AA1100, AA1145, AA7072, AA8005, and AA8011.

14. The heat exchanger of claim 12, wherein the fin surface layer covers a region of the fin body portion in contact with the exterior of the conduit.

15. The heat exchanger of claim 12, wherein the fin surface layer encases the fin body portion.

16. The heat exchanger of claim 12, wherein the fin surface layer has a thickness of 15-250 microns.

17. The heat exchanger of claim 12, wherein the fin surface layer has a thickness of 5-50 microns.

18. The heat exchanger of claim 12, wherein the fin surface layer is applied by a thermal spray process or vapor deposition.

19. The heat exchanger of claim 1, wherein the alloying element is selected from barium and gallium.

* * * * *